United States Patent [19]

Arendt

[11] 3,935,903

[45] Feb. 3, 1976

[54] WELL TUBING PROTECTIVE FLUID INJECTION SYSTEM

[75] Inventor: Henry P. Arendt, Dallas, Tex.

[73] Assignee: Otis Engineering Corporation, Dallas, Tex.

[22] Filed: Apr. 2, 1975

[21] Appl. No.: 564,276

[52] U.S. Cl. ..... 166/184

[51] Int. Cl.[2] ..... E21B 33/12

[58] Field of Search ..... 166/179, 184, 131

[56] References Cited

UNITED STATES PATENTS

| | | | |
|---|---|---|---|
| 2,389,985 | 11/1945 | Justice et al. | 166/131 |
| 3,044,553 | 7/1962 | Bradley | 166/131 |
| 3,583,481 | 6/1971 | Vernotzy | 166/184 |
| 3,853,177 | 12/1974 | Mott | 166/184 |

*Primary Examiner*—James A. Leppink

*Attorney, Agent, or Firm*—Warren H. Kintzinger

[57] ABSTRACT

A down-the-hole well tubing protective fluid system, with an injection valve in fluid communication with a ported nipple above a packer assembly, for introduction of protective fluid to the tubing bore. The system includes a concentric protective fluid flow path, extended for fluid flow to below the injection nose and through the bore of the packer, and packer tail pipe for introduction of protective fluid into the well-producing flow path below the packer, to provide protection for the packer assembly, inside and outside, below the packer seal, the injection nose, and the injection valve tail pipe. When the injection tail pipe nose is installed to extend below the lower end of the packer tail pipe, the turbulence caused by production fluid entering the tail pipe nose carries diluted chemical fluid mix up, and around, the outside of the packer tail pipe.

9 Claims, 4 Drawing Figures

WELL TUBING PROTECTIVE FLUID INJECTION SYSTEM

Figure 1A:
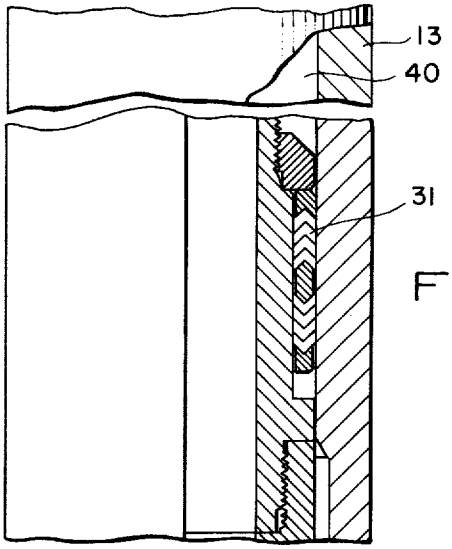

This invention relates in general to systems for introducing protective fluid to a well tubing bore, and in particular, to a well tubing protective fluid injection system with a chemical fluid flow path through a passage between the bore of the packer and the packer tail pipe and the outside of an injection nose assembly, to below the injection nose.

Oil wells normally include a string of steel pipe, or casing, contained within the well bore and extending from the producing strata to the wellhead at the earth's surface. Space between the casing and the well bore is usually filled with cement, forming a sheath; and a string of tubing is generally suspended within the casing, from the wellhead—with the space between the casing and the tubing being called the casing annulus. The casing and cement sheath are generally perforated at a production zone to allow well production flow to the interior of the casing, below the well packer; a production packer assembly generally being used to seal off the casing annulus at a point close to, but above, the perforations.

Oil wells producing crude oil with highly corrosive fluids; for example, $H_2S$, and/or $CO_2$, such as in sour crude, many times need to be treated by introducing, into the tubing bore, protective chemical fluids that inhibit or reduce the effect of the corrosive fluids. A protective chemical such as commercially available VESCO, is generally diluted with condensate or diesel oil and is pumped at the wellhead into the casing annulus. Thus the inside of the casing, and the outside of the tubing contained within the casing, are protected, with any other fluids previously present in the casing annulus being flushed out when the well is completed, by pumping in the protective fluid to provide a solid column of the protective fluid in the casing annulus above the packer assembly seal. In a previous approach to providing tubing bore protection, a ported nipple assembly is installed immediately above the well packer assembly, with a spring-biased check valve assembly inside the ported nipple assembly to prevent well fluids from causing back-flow contamination of the casing annulus. With this approach, as pump pressure is increased to protective fluid in the casing annulus, the valve spring force is overcome and the protective chemical fluid is injected into the well tubing bore where it mixes with, and is carried by, the well production fluid flowing upward through the tubing bore, to thereby provide protection for the tubing bore.

It should be noted that with such previous systems a particular disadvantage is that only tubing above the port in the ported nipple can be protected. This leaves the packer assembly body, and any associated tail pipe below the packer assembly, without protective chemical fluid contact, and susceptible, therefore, to corrosive attack.

It is therefore a principal object of this invention to provide well tubing protective fluid injection flow to below the ported nipple.

Another object is to provide such protective fluid injection flow, through a chemical fluid flow path that results in more complete chemical fluid contact with well tubing surfaces to be protected, than in prior art systems.

A further object is to provide such protective fluid injection with a spring valve in a flow path delivery system from casing annulus entry above the packer assembly, to final delivery at the packer tail pipe.

Features of this invention useful in accomplishing the above objects include, in a well tubing protective fluid injection system, a ported nipple assembly opening into the casing annulus, a spring-loaded check valve assembly, and an injection nose assembly in the vicinity of the packer tail pipe. Passages are provided for fluid flow from the casing annulus, through the check valve assembly, to the injection nose assembly, where the protective fluid is mixed with the production well fluid to coat and protect the packer assembly, as well as the tubing bore.

Specific embodiments representing what are presently regarded as the best modes of carrying out the invention are illustrated in the accompanying drawings.

Figure 2:
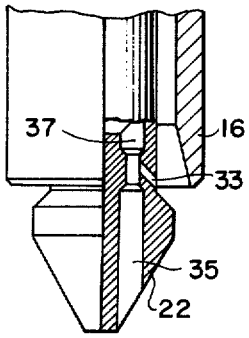
Figure 3:
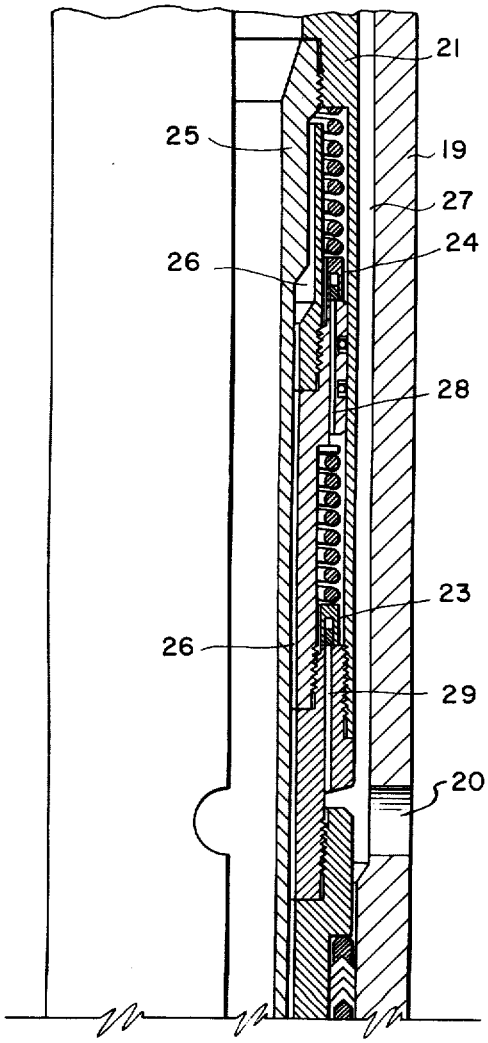
Figure 3:
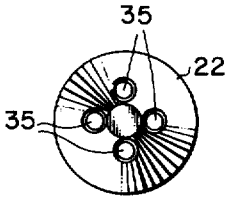
Figure 1B:
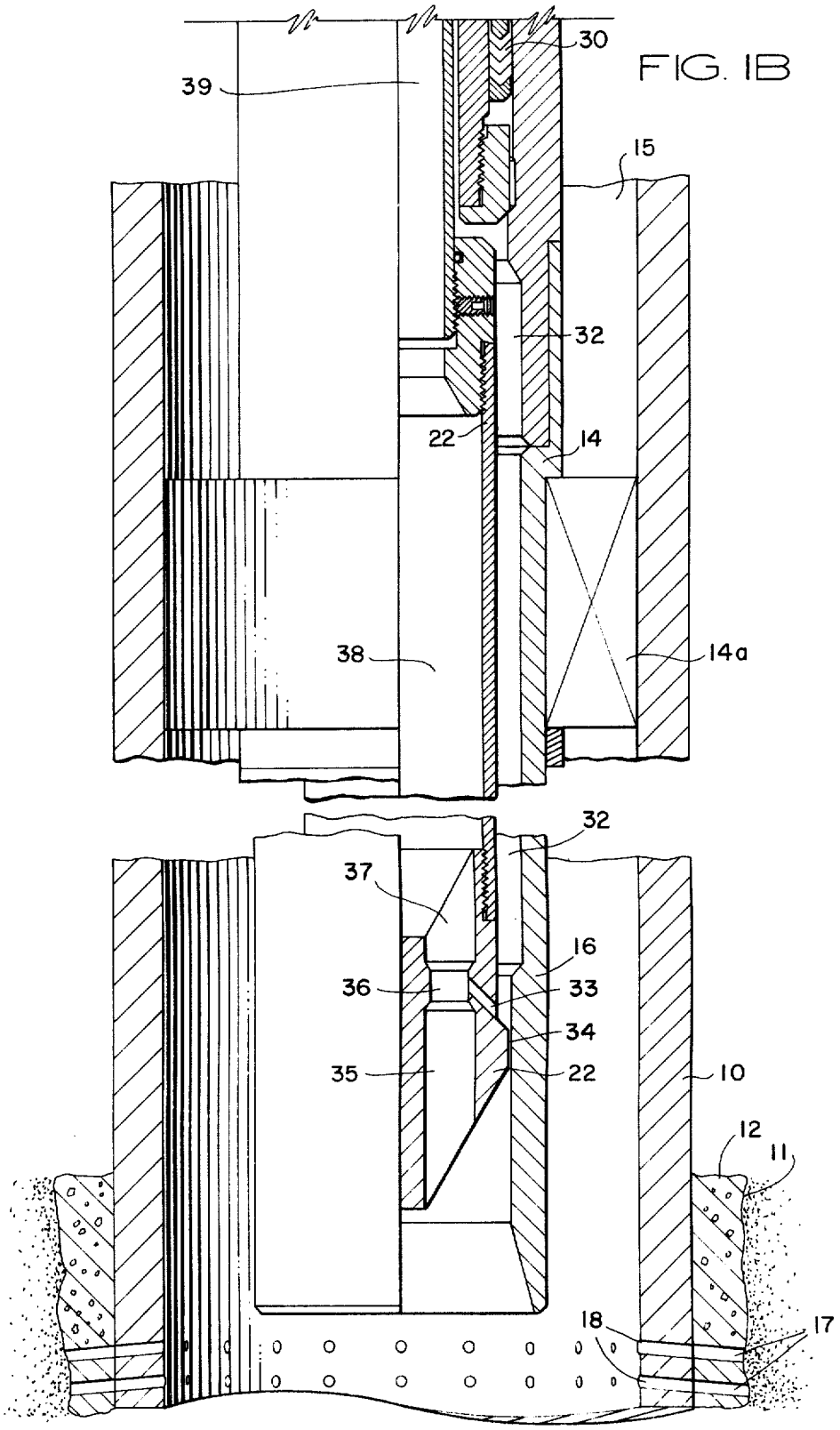

In the drawings:

FIGS. 1A and 1B, arranged with FIG. 1A above FIG. 1B, represent a partially broken away side view showing an illustrative embodiment of the invention as part of the production equipment of a well;

FIG. 2, an alternate positioning of the injection nose assembly according to this invention; and, FIG. 3, a bottom view of the injection nose assembly according to this invention.

Referring to the drawings:

A casing 10 is shown suspended in a well bore 11, with cement sheath 12 filling the annular space between casing 10 and well bore 11. A string of tubing 13 is suspended within casing 10 and a production packer assembly 14, with an associated packer seal 14*a*, seals off the bottom end of casing annulus 15, the space between the outside of packer tail pipe 16, an extension of tubing 13, and the inside of casing 10. Packer tail pipe 16 is open ended, to permit the flow of oil coming through perforations 17 and 18, in cement sheath 12 and casing 10, respectively, to move upwardly toward the wellhead. Connecting tubing 13 with packer assembly 14, is a ported nipple assembly 19. Ported nipple assembly 19 allows the entry of protective fluid from casing annulus 15, through port 20, into the well tubing bore in a manner described hereinafter.

Nipple assembly 19 encloses a chemical injection valve assembly 21, and injection nose assembly 22 is positioned within packer assembly 14. Chemical injection valve assembly 21 includes two spring-loaded check valves 23 and 24, of conventional design, connected in series with valve 24 in spaced relation above valve 23. A sleeve 25, inside the valve assembly 21, is spaced from valve assembly 21 to provide a passage 26 therebetween. This passage is open at its upper end to valve 24 for fluid flow therefrom, and valve and nipple assembly 20 are so constructed that annulus 27 is formed therebetween, with a connection at its lower end, to port 20. Within valve assembly 21, passage 28 connects valves 23 and 24, and a passage 29 connects valve 23 to annulus 27, that is sealed at its lower end by V-seal 30, and at its upper end by V-seal 31. The outer diameter of injection nose assembly 22 and the inner diameter of tail pipe 16 of packer assembly 14 are sized to form annular passage 32, having four lower end ports 33 and a narrow bottom end annular passage 34. Injection nose assembly 22 includes four bores 35, spaced as shown in FIG. 3, and formed with an intermediate throat constriction bores 36, of reduced diameter, leading thereabove to larger bores 37 that open into an enlarged mixing bore 38. Mixing bore 38 is in open fluid flow communication to the interior 39 of sleeve 25 that connects at its upper end to valve assembly 21 for upward production flow through to tubing bore 40, and to the wellhead.

With well production flow operation, when it is desired to introduce the protective fluid from casing annulus 15 into the tubing bore, protective fluid pressure in annulus 15 is increased through fluid pumping at the wellhead. This forces protective fluid from annulus 15 through port 20 into annulus 27 and thence into passage 29, increasing fluid valve opening pressure on spring-loaded check valve 23 sufficient to overcome the closing force provided by the spring in check valve 23. This allows protective fluid to flow through check valve 23 into passage 28 and apply pressure sufficient to open spring-loaded check valve 24. Then the fluid flows through check valve 24, enters passage 26, and flows on into passage 32. Normally, natural underground pressure, in wells that would use this protective fluid equipment, is such that well fluid flows through perforations 17 and 18, in delivery to open end of packer tail pipe 16, and on through bores 35, throat 36, bore 37, bore 38, bore 39, and thence upward to the wellhead, through tubing bore 40. In keeping with the well known venturi principle that as the velocity of flow of a fluid increases in the throat, the pressure decreases, a relatively low fluid pressure area is formed in throat 36—helping to draw protective fluid from passage 32, through ports 33, to bore opening throats 36, where it mixes with the well production fluid and travels up to the wellhead, thereby coating and protecting the interior of the packer assembly 14 and the tubing bore 40. Additional protective fluid is forced through annular passage 34, where it mixes with the well fluid at the open end of packer tail pipe 16 before being drawn into and through bore openings 35. Thus, it is seen that through the use of the illustrated embodiment, protective fluid is introduced into the production flow below the packer assembly, thereby providing protection for the packer assembly as well as for the tubing bore.

With the alternate injection nose assembly positioning shown in FIG. 2, a tail pipe 22 length is used in assembly, at the surface, to result in placement of the lower end of the injection nose assembly 22, below the lower end of the packer tail pipe 16. Fluid turbulence caused with production well fluid flow entering the packer tail pipe 16, results in protective fluid being carried up and around the outside of the packer tail pipe 16, in providing protection therefor and for the outside of packer assembly 14.

Whereas this invention is herein illustrated and described with respect to a specific embodiment thereof, it should be realized that various changes may be made without departing from the essential contributions to the art made by the teachings hereof.

I claim:

1. A well tubing protective fluid injection system adapted for use in a well that is equipped with casing, tubing, and a packer assembly—a casing annulus being formed between the casing and the tubing; said system including: a nipple assembly intermediate said tubing and said packer assembly; said nipple assembly including an opening between the casing annulus and the interior of said nipple assembly; a valve assembly inside said nipple assembly forming an annular opening between the exterior of said valve assembly and the interior of said nipple assembly; said valve assembly comprising check valve means, open at one end to the interior of said valve assembly, and at the other end, to said annular opening; sleeve means inside said valve assembly, and spaced from said valve assembly to form a first passage therebetween; said first passage being connected to said one end of said check valve means, the interior of said sleeve means connecting in open fluid communication with the tubing bore; and an injection nose assembly supported within said packer assembly and dimensioned to form a second passage, a passage between the injection nose assembly and said packer assembly, connected in fluid communication with said first passage; and said injection nose assembly including bore means therein extending from the injection nose assembly bottom end to the interior of said sleeve means.

2. The well tubing protective fluid injection system of claim 1, wherein said injection nose assembly extends below the packer tail pipe.

3. The well tubing protective fluid injection system of claim 1, wherein said injection nose assembly includes, an injection nose tail pipe and injection nose head means; with said second passage longitudinally extended between the interior of said packer assembly and said injection nose tail pipe; and with said injection nose head means and said packer assembly tail pipe dimensioned to provide fluid flow passage means connecting said second passage in fluid communication to the bottom end production entry zone of said packer assembly tail pipe below said injection nose head means when the injection nose head means is positioned within said packer assembly tail pipe.

4. The well tubing protective fluid injection system of claim 3, including protective fluid passage opening means interconnecting said second passage and said bore means; and, wherein said fluid flow passage means is dimensioned for less protective fluid through-flow than the protection fluid flow passing through said protective fluid passage means.

5. The well tubing protective fluid injection system of claim 1, wherein said check valve means is spring-loaded check valve means.

6. The well tubing protective fluid injection system of claim 5, wherein said spring-loaded check valve means comprises a plurality of individual spring-loaded check valves in spaced series relation to each other.

7. The well tubing protective fluid injection system of claim 1, wherein said bore means includes throat constriction means; and said injection nose assembly includes opening means interconnecting said second passage to said throat constriction means.

8. The well tubing protective fluid injection system of claim 7, wherein said bore means comprises a plurality of bore passageways; and said throat constriction means is a throat portion of reduced diameter in each of said plurality of bore passageways.

9. The well tubing protective fluid injection system of claim 8, wherein said opening means interconnecting said second passage to said throat constriction means is a plurality of openings, each interconnecting said second passage to a throat portion in said plurality of bore passageways.

* * * * *